United States Patent [19]

Buss et al.

[11] Patent Number: 4,622,539

[45] Date of Patent: Nov. 11, 1986

[54] ALARM SYSTEM WITH ALARM MESSAGE SUPERVISION

[75] Inventors: Leonard A. Buss, Mt. Prospect; Phillip J. Loeb, Palatine; Daniel G. Prysby, Elk Grove, all of Ill.

[73] Assignee: Honeywell Inc., Minneapolis, Minn.

[21] Appl. No.: 606,439

[22] Filed: May 3, 1984

[51] Int. Cl.[4] ..... G08B 29/00

[52] U.S. Cl. ..... 340/506; 340/508; 340/509; 340/511; 340/539; 340/534

[58] Field of Search ..... 340/506, 508, 509, 511, 340/539, 692, 825.06, 534; 330/2; 179/5 R, 5 P, 175, 175.2 C, 175.3 F; 455/67, 9, 115; 377/19

[56] References Cited

U.S. PATENT DOCUMENTS

| | | | |
|---|---|---|---|
| Re. 30,588 | 4/1981 | Tamaru et al. | 368/203 |
| 3,618,083 | 11/1971 | Burley et al. | 340/506 |
| 4,056,817 | 11/1977 | Bachman | 340/692 |
| 4,060,803 | 11/1977 | Ashworth, Jr. | 340/506 |
| 4,254,410 | 3/1981 | Virkus | 340/506 |
| 4,266,219 | 5/1981 | Foster et al. | 340/506 |

*Primary Examiner*—Donnie L. Crosland
*Attorney, Agent, or Firm*—Trevor B. Joike

[57] ABSTRACT

An alarm message generation and broadcast system having supervision including an alarm message generation circuit for generating an alarm message, an output for receiving the alarm message so that the alarm message can be broadcast in response to an alarm event; and a supervision circuit connected to the alarm message generation circuit and responsive to the alarm message for providing a trouble signal when the alarm message is not properly received by the supervision circuit.

48 Claims, 8 Drawing Figures

ALARM SYSTEM WITH ALARM MESSAGE SUPERVISION

BACKGROUND OF THE INVENTION

The present invention relates to an alarm message generation system for generating and broadcasting an alarm message in the event of an alarm event and, more particularly, to such a system wherein the integrity of the system is supervised by supervising the alarm message itself rather than a superimposed supervision signal.

Fire and security alarm reporting systems which provide local and/or remote alarms upon the occurrence of fires or breaches in security require supervision of the alarm reporting system to prove the integrity of that system so that assurance will be given that, when a fire or a breach of security occurs, the proper alarm will be generated and broadcast. Prior art supervisory systems have usually involved superimposing a signal upon the alarm reporting system and sensing for the presence of that signal in order to ensure the integrity of the alarm reporting system itself. Thus, if the superimposed supervisory signal passes through the alarm generating and broadcast system properly, then it follows that the alarm message itself will pass through the system properly when an alarm event occurs.

Supervising the integrity of an alarm reporting system by superimposing a signal upon the system and sensing for that signal has several drawbacks. Such a supervisory technique requires a generator for the supervisory signal in addition to the alarm signal generator. Furthermore, special care must be taken to select those electronic alarm reporting system components which are frequency compatible with both the frequency of the alarm signal to be broadcast in the case of an alarm condition and the frequency of the superimposed supervisory signal. This latter requirement imposes restrictions upon component selection which can increase the cost and complexity of the system.

SUMMARY OF THE INVENTION

The need for matching frequency response characteristics of the electronic alarm reporting system components to both the frequency of the alarm signal to be broadcast and the supervisory signal and the need for a separate oscillator to provide the supervisory signal are eliminated by the present invention which uses the alarm message to be broadcast as not only the alarm message but also the supervisory signal. Accordingly, the present invention involves an alarm message generation and broadcast system having supervision including an alarm message generation circuit for generating an alarm message, an output for receiving the alarm message so that the alarm message can be broadcast in response to an alarm event, and a supervisory circuit connected to the alarm message generation circuit and reponsive to the alarm message for providing a trouble signal when the alarm message is not properly received by the supervisory circuit.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
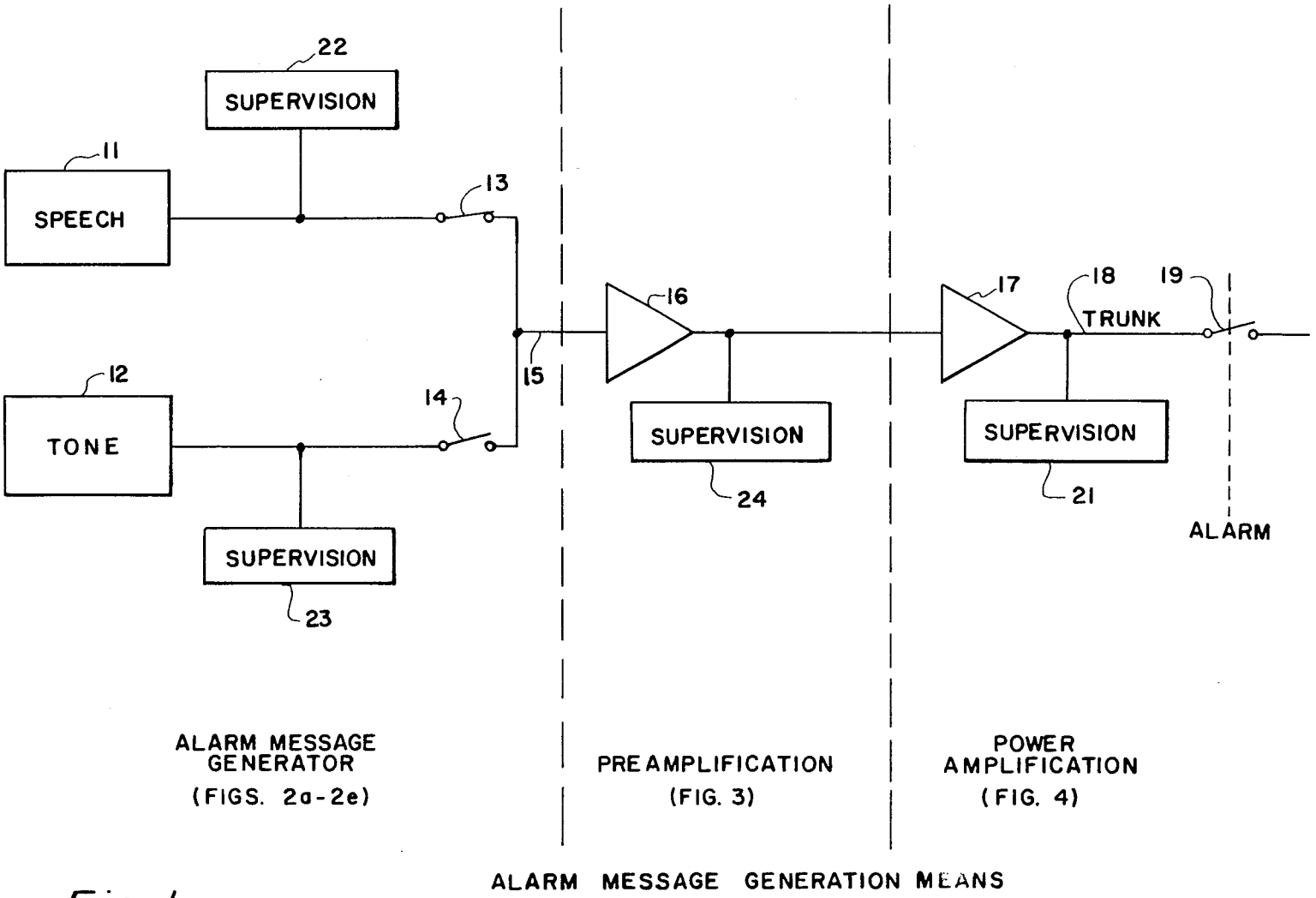
FIG. 1 is a block diagram of the invention.

The alarm message generation means shownin FIG. 1 consists of speech generation circuit 11 for generating a verbal or speech alarm message to be broadcast in the event of an alarm and tone alarm message generation circuit 12 for generating a tone alarm message such as a slow whoop in the event of an alarm. Switches 13 and 14 are used to select one or the other type of alarm message to be broadcast. In addition, it may be possible to broadcast both types of signals. For example, the tone alarm message may be generated first for a predetermined period of time as an alert that a speech alarm message will follow. The alarm message appearing on line 15 is then amplified by preamplifier 16 and further amplified by power amplifier 17 before it is transmitted to the output, i.e. trunk line 18. Switch 19 may connect trunk line 18 to the various speakers or sirens for broadcasting the alarm message. Switch 19 will close in the event of an alarm so that the alarm message can be broadcast.

Instead of superimposing the prior art 20 Hz. to 30 Hz. signal on an alarm generating and broadcast circuit and then supervising that signal, the present invention eliminates the need for a separate oscillator and for frequency matching the electronic components used in the alarm reporting system to both the frequency of the supervisory signal and the frequency of the alarm message signal by supervising the alarm message itself. Thus, as shown in FIG. 1, the alarm message to be broadcast in the event of an alarm is supplied to trunk line 18 up to switch 19 so that the supervisory signal can be sensed not only at the trunk line, but also at the output of the speech alarm message generator 11, the tone alarm message generator 12 and the preamplifier 16. Corresponding supervision circuits 21, 22, 23 and 24 are provided for this function. Since the alarm message is always present at these four points in the system as shown in FIG. 1, continual supervision can be conducted to ensure the integrity of the alarm message generating and broadcast system. If an alarm event should occur, switch 19 closes connecting the alarm message which is present on trunk line 18 to the various broadcast mechanisms such as speakers and/or sirens for broadcasting the alarm message.

FIGS. 2A–2E show the details of the alarm message generator section of FIG. 1. Speech synthesis is provided by speech synthesis circuit 31 shown in FIG. 2B. This speech synthesis circuit has an internal oscillator the frequency of which is set by capacitor 32, potentiometer 33 and resistor 34. Speech synthesizer 31 provided a clock output signal at pin 3 which is divided down by counter 35 in order to clock the write select input at pin 27 of speech synthesizer circuit 31. The read select pin 28 is driven from a power up reset signal which will clear speech synthesizer circuit 31 when the read select input pin 28 is low. For normal operation, read select input pin 28 is normally high. Each time write select input pin 27 goes low, the input data bus D0–D7 is read.

Figure 2A:
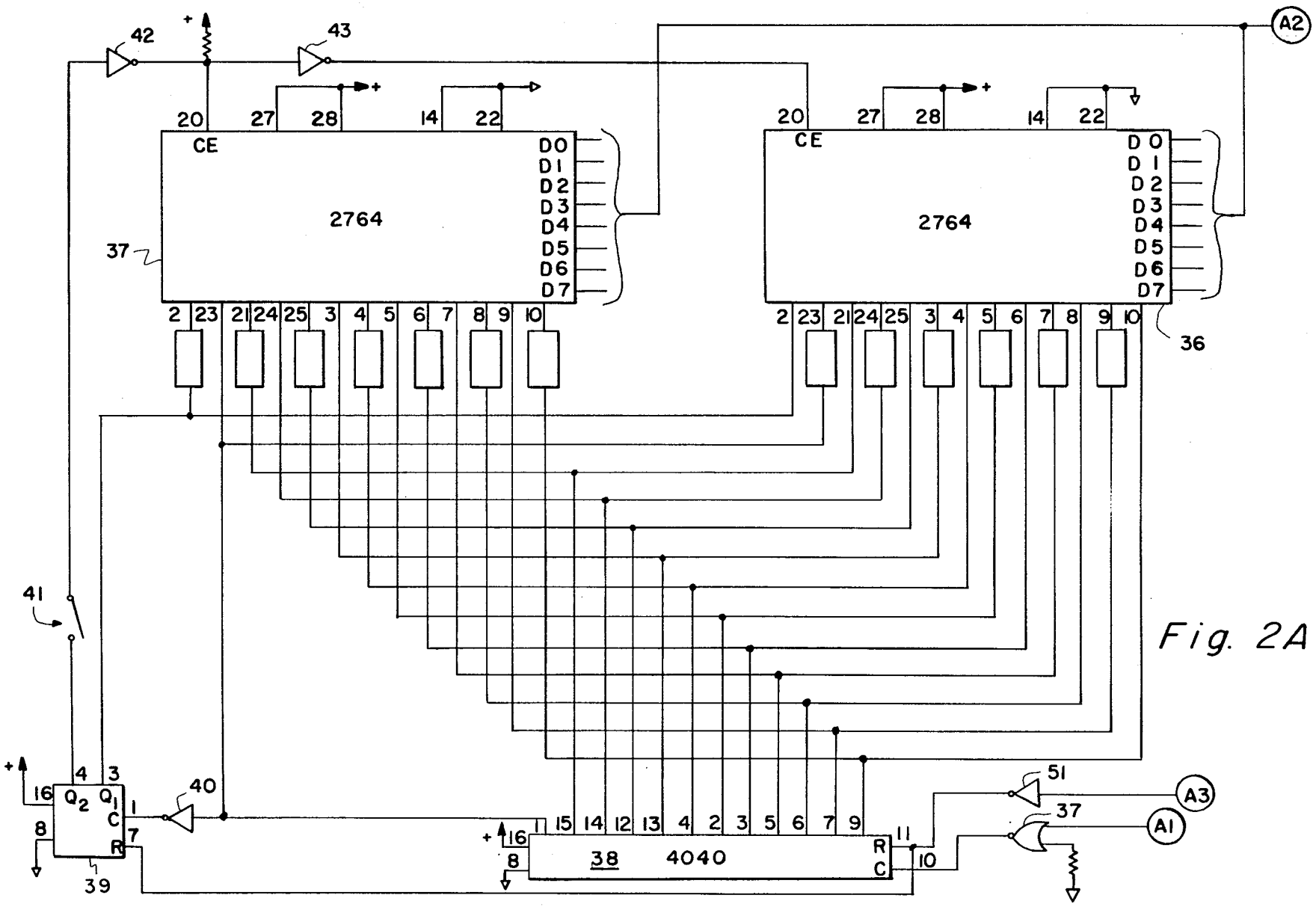
FIG. 2A–2E show the details of the alarm message generator shown in block form in FIG. 1.

The information into the input data pins D0–D7 of speech synthesizer 31 is derived from speech memory circuits 36 and/or 37 (FIG. 2A). Speech memory circuit 37 is provided in the case that more than one memory chip is required for storing the speech alarm messages to be broadcast in the event of an alarm.

Every time the write select input pin of speech synthesizer 31 is clocked low, its ready output pin 18 goes high. This signal is inverted by inverter 37 as shown in FIG. 2A and is used to clock address counter 38. Output pin 1 of address counter 38 is used to clock address counter 39 through inverter 40 and the outputs of address counters 38 and 39 provide the address for speech memory circuit 36 and 37 in order to supply the data sorted therein to the data input pins of speech synthesizer 31.

The most significant address bit, output pin 4 from address counter 39, is used to select the appropriate memory 36 or 37 which is to be enabled. Memory 36 is the least significant memory address and is used in the case where only one memory chip is necessary. Accordingly, the most significant address bit is supplied through switch 41 and inverter 42 to the chip enable input of memory 37 and further through inverter 43 to the chip enable input of memory 36. Switch 41 is closed when both memory 36 and 37 are used.

As noted above, the message alarm signal is continuously generated and routed through the alarm message generator, the preamplifier and the power amplifier as shown in FIG. 1 so that this signal can be supervised. However, it may be expedient upon the sensing of an alarm to insure that the message alarm signal to be broadcast begins at the beginning. To accomplish this function, a message enable input 44 (FIG. 2B) is provided and is connected through filter coil 45 for static protection, inverted by inverter 46 and used to trigger monostable multivibrator 47 through switch 48 which is closed when the speech alarm message is selected. The monostable multivibrator 47 resets address counters 38 and 39 through OR gate 49, terminal A3 and inverters 51 (FIG. 2A).

Switch 48 is closed when only the speech message is to be broadcast. In this cast, as discussed above, monostable multivibrator 47 receives the message generation signal as a trigger input and provides a short reset pulse to the address counters 38 and 39 through NOR gate 49 shown in FIG. 2B, terminal A3 and inverter 51 shown in FIG. 2A. If, on the other hand, both the tone alarm message and the speech alarm message are selected, switch 48 remains open and switch 62 is closed so that the tone alarm message is broadcast for a length of time prior to the broadcast of the speech alarm message. This amount of time is established by potentiometer 53, resistor 54 and capacitor 55 in association with monostable multivibrator 52. Monostable multivibrator 52 provides a delay from receipt of the message enable signal at input 54 to the provision of the reset pulse by monostable multivibrator 47 to the address counters 38 and 39 in FIG. 2A.

If switch 48 is closed and switch 62 is open, the message enable signal is essentially supplied to both inputs of NOR gate 61 which is then connected through switch 63 which is closed when either the tone alarm message or the speech alarm message or both are selected. This signal is inverted at 64 and used to control analog switch 65 (FIG. 2E) through terminal B1 for connecting the speech message to the output of FIG. 2E. If, on the other hand, switch 62 is closed, then analog switch 65 connects the tone alarm message to its output for the period of time established by potentiometer 53, resistor 54 and capacitor 55 of FIG. 2B before the speech alarm message is then connected to its output.

Figure 2B:
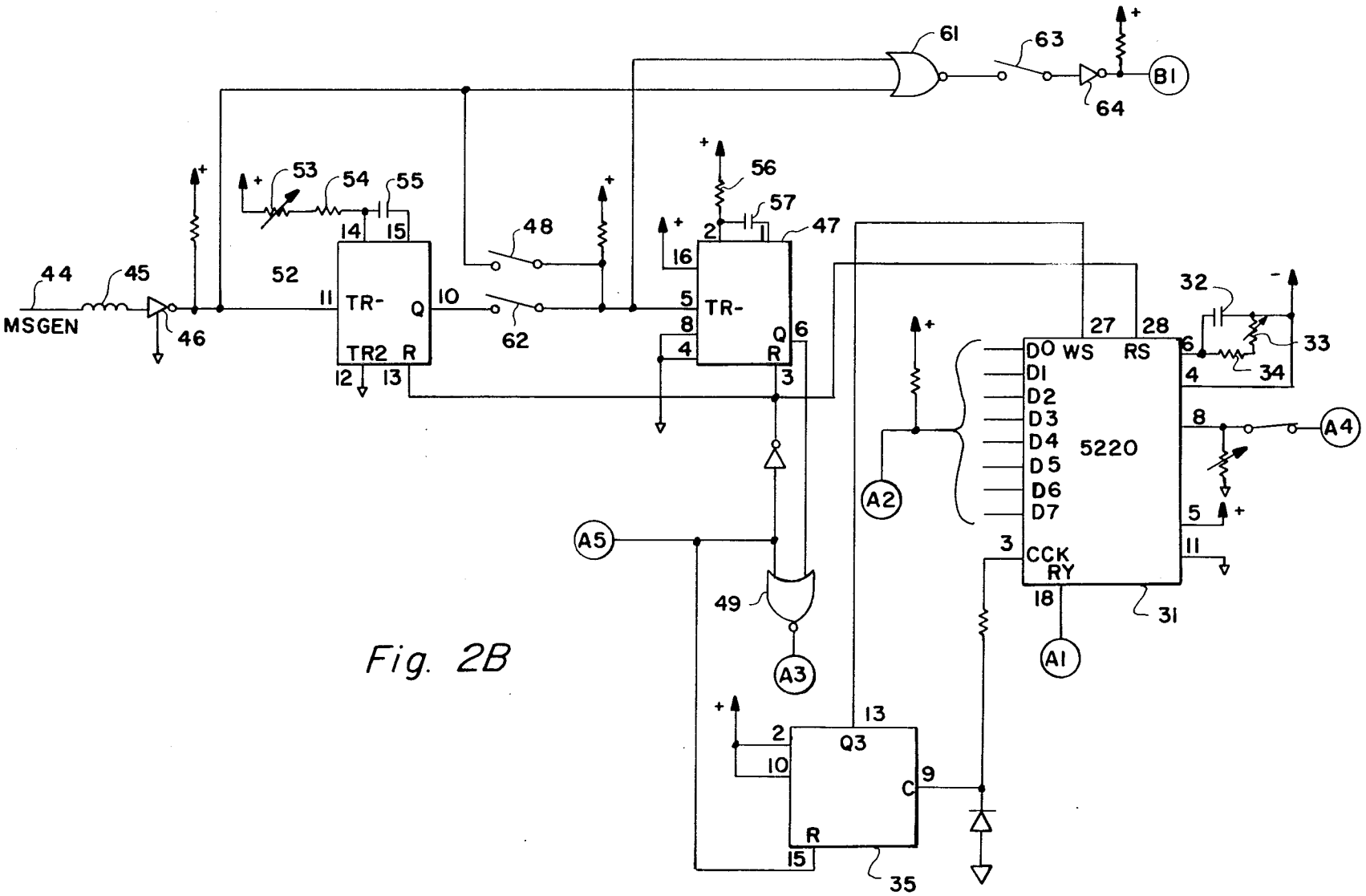
Figure 2C:
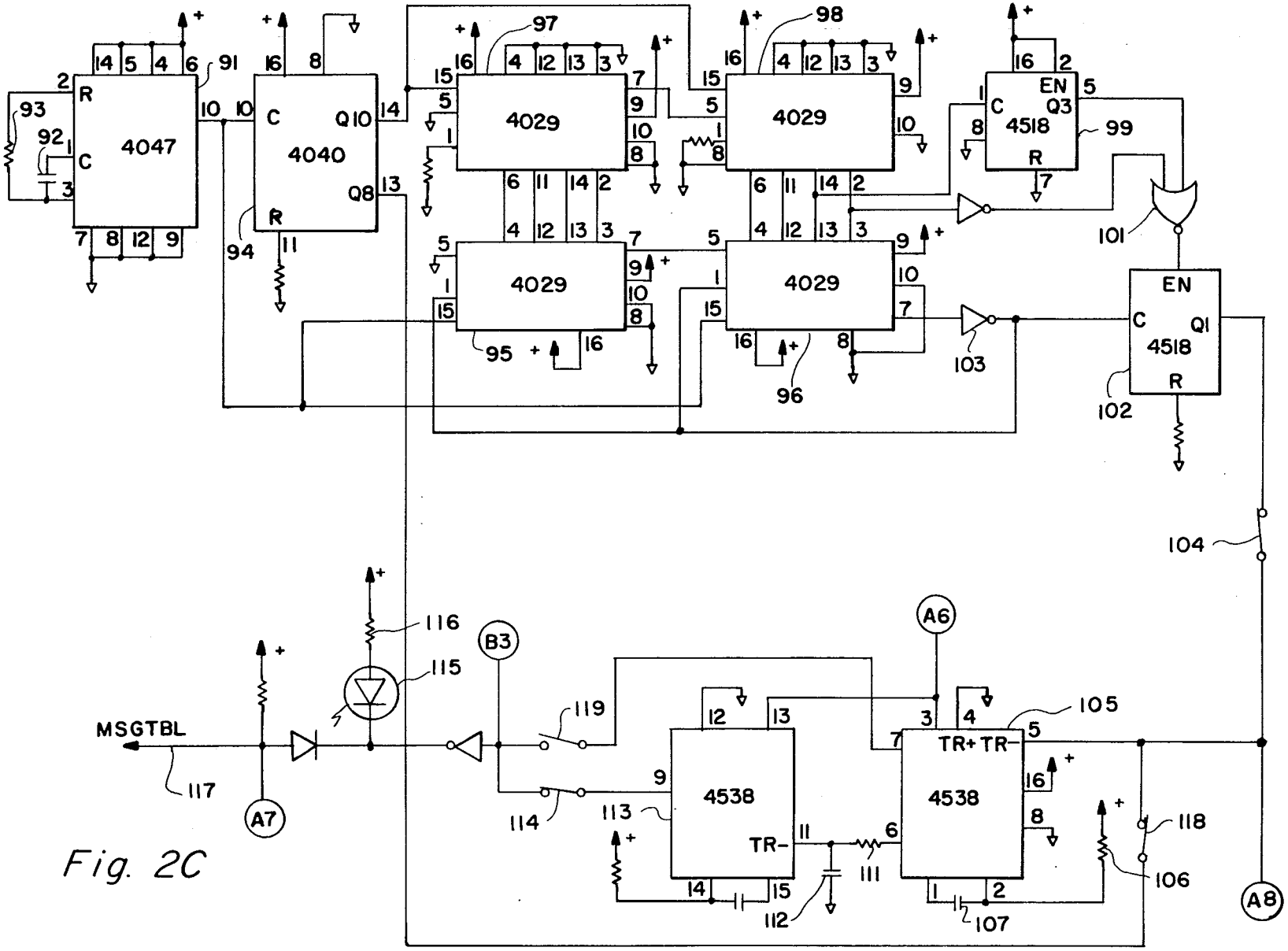
Figure 2D:
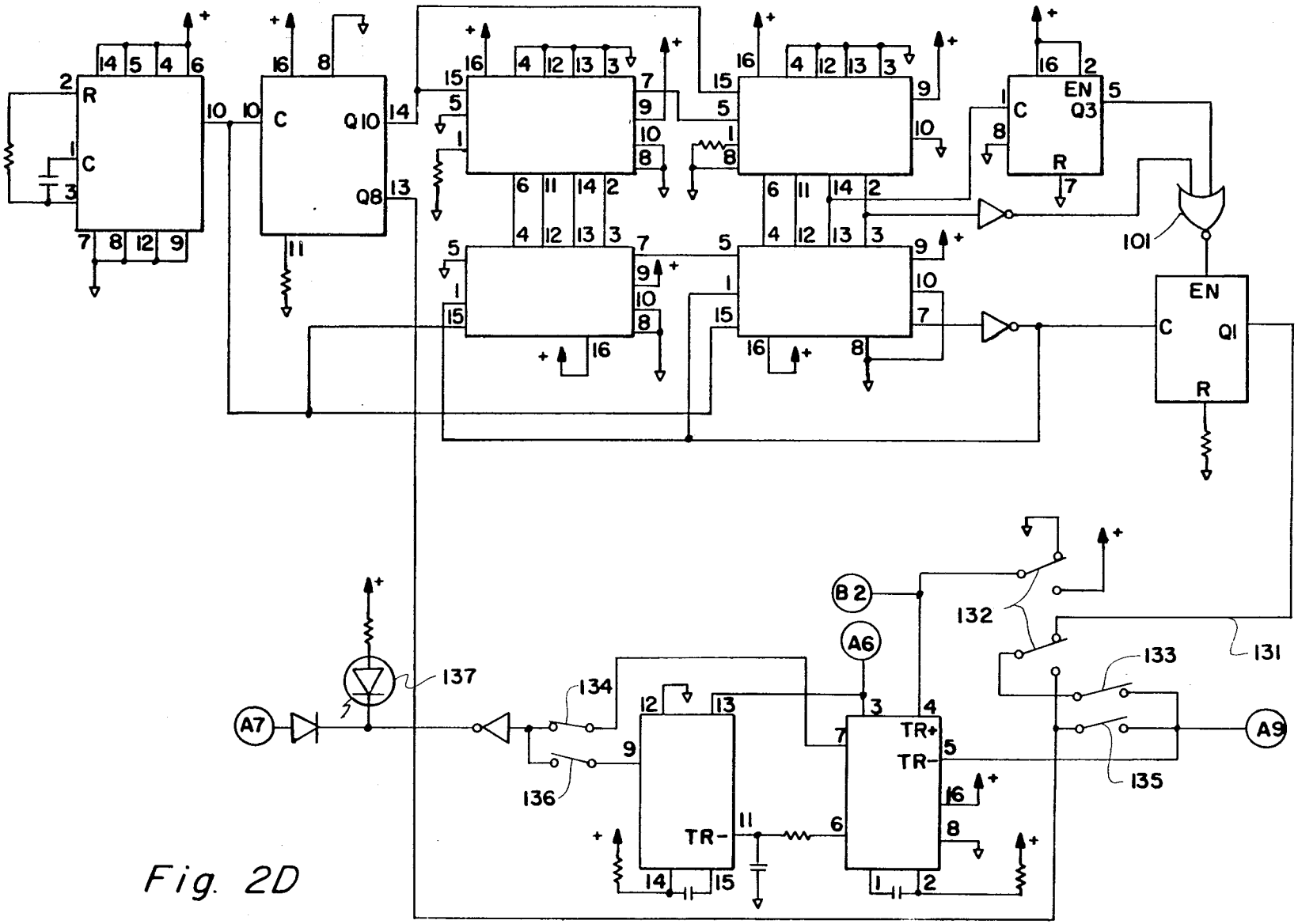
Figure 2E:
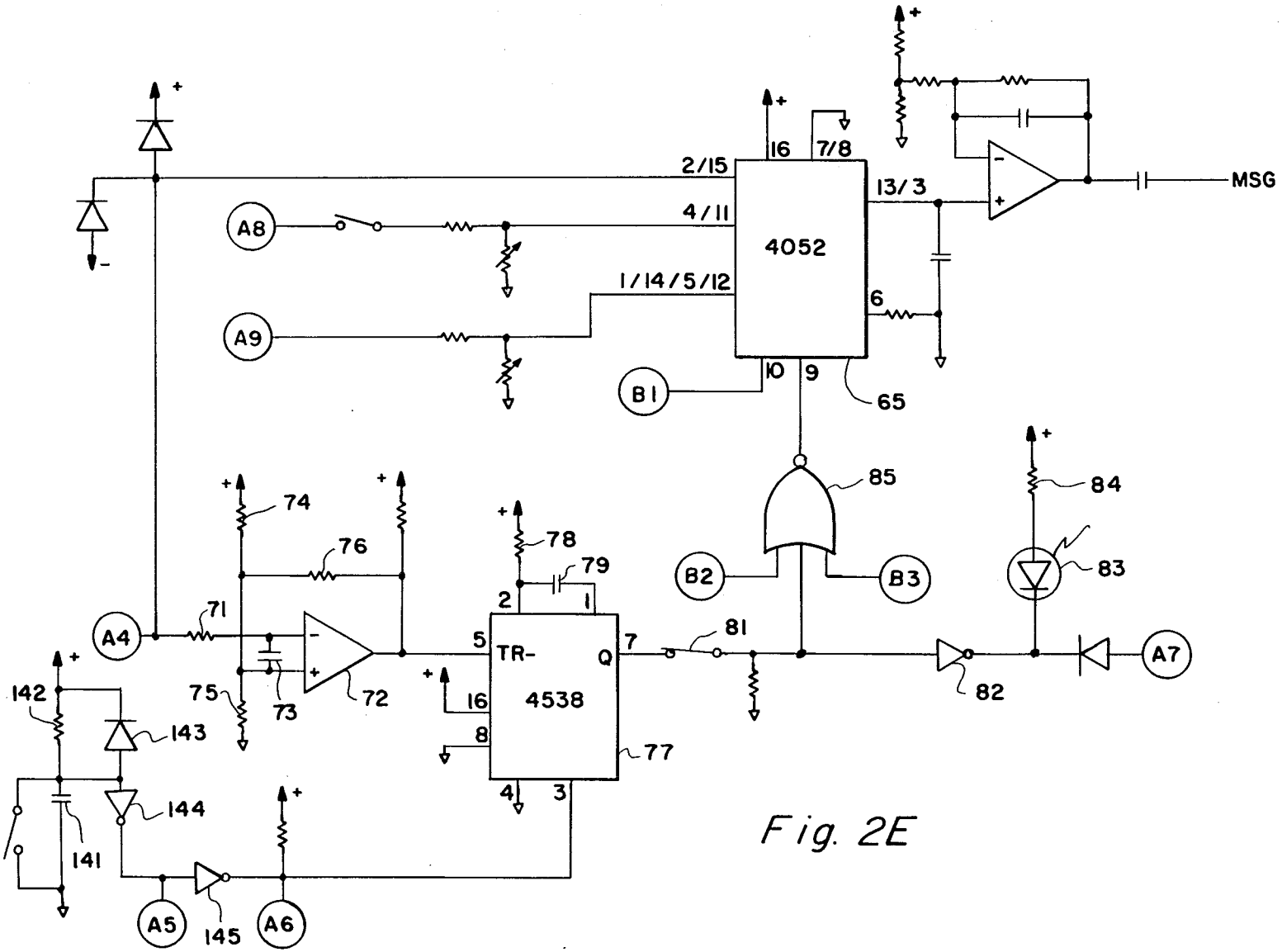

FIG. 2E shows not only analog switch 65 for connecting the speech alarm message and/or the tone alarm message to the output of the alarm message generator, MSG, it also shows the speech synthesis supervision circuitry utilized to supervise the speech alarm message to insure the integrity of the speech generator. The output of speech synthesizer 31 at terminal A4 as shown in FIG. 2B is connected through the corresponding terminal A4 of FIG. 2E to one input of analog switch 65 and also through resistor 71 to the negative input of comparator 72. Resistor 71 together with capacitor 73 act as a high frequency filter for comparator 72. The reference voltage for comparator 72 is established by a voltage divider circuit comprising resistors 74 and 75. Feedback resistor 76 provides comparator 72 with hysteresis. Each time the speech message voltage crosses the reference voltage established by voltage divider 74-75, the output of comparator 72 changes state. Each change of state of this output triggers retriggerable monostable multivibrator 77. The absence of trigger pulses, i.e. the absence of speech synthesis, allows monostable multivibrator 77 to time out after a period of time established by resistor 78 and capacitor 79. When monostable multivibrator 77 times out, its output goes high through switch 81 such that the output of inverter 82 goes low turning on the speech alarm message trouble indicator 83 through limiting resistor 84. Also, the speech alarm message trouble indication signal is connected through terminal A7 to a message trouble output terminal (FIG. 2C). The speech alarm message trouble signal is also used through NOR gate 85 to switch analog 65 so that instead of the faulty speech alarm message signal being connected to the output MSG, the tone alarm message can be connected to the output instead.

The tone alarm message generator is shown in more detail in FIG. 2C. Oscillator 91 produces a square wave output using capacitor 92 and resistor 93. This output clocks counters 94, 95 and 96. The signal on pin 14 of counter 94 is used to clock counters 97 and 98. Counter 97 counts down a predetermined number of clock pulses at which time counter 97 generates a carry signal to allow counter 98 to start counting down. The outputs of counters 97 and 98 together produce a binary countdown and are used to jam the inputs of counters 95 and 96, respectively. The entire countdown is repeated continuously. Pin 14 of counter 98 is divided by counter 99 to produce a BCD signal which when combined with the signal at pin 2 of counter 98 by NOR gate 101 is used to control counter 102 for producing a slow whoop tone alarm message signal.

Counters 95 and 96 continuously count down from the count of their jam inputs. Since the jam count is continuously reducing, the time required for counters 96 and 96 to count down is continuously reducing which thus increases the frequency of the signal output at pin 7 of counter 96. This increasing frequency signal, or slow whoop, is inverted by inverter 103 and is used to clock counter 102. Counter 102 produces a 50% duty cycle signal which is modulated by the signal from NOR gate 101 and is ½ the frequency of the slow whoop input at the clock terminal of counter 102. The output of counter 102 is connected through switch 104 which is closed whenever the tone alarm message signal is to be connected to an input of switch 65 through terminal A8.

The output from counter 102 is also connected to the input of the tone alarm message supervisory circuit also shown in FIG. 2C. This signal is used to trigger retriggerable monostable multivibrator 105 which detects the presence of the high frequency component of the tone alarm message. If a signal does not trigger monostable multivibrator 105 within an amount determined by resistor 106 and capacitor 107, output pin 6 of monostable multivibrator 105 sets (goes high). Since certain tone alarm message failure modes will trigger monostable multivibrator 105 to produce short pulses at its output, a low pass filter comprising resistor 111 and capacitor 112 is provided to remove the short pulses output from monostable multivibrator 105 in these failure modes. The filtered output from monostable multivibrator 105 will trigger retriggerable monostable multivibrator 113 which detects the presence of the low frequency component of the tone alarm message. The output from monostable multivibrator 113 passes through switch 114 and is used to activate the tone alarm message trouble indicator 115 through limiting resistor 116. This message is also supplied to the message trouble terminal 117.

In certain cases, it may be desirable to select a steady tone instead of a slow whoop tone. In this case, pin 13 of counter 94 produces a fixed frequency output signal which is connected to the input of monostable multivibrator 105 through switch 118. If this signal is selected, then switch 118 is closed, switch 114 is opened, switch 119 is closed and switch 104 is opened. This fixed frequency signal will repetitively trigger monostable multivibrator 105. Upon a loss of this signal, output pin 7 of monostable multivibrator 105 will switch and is used to energize the trouble indicating lamp 115.

At the same time, if the tone alarm message is lost because of a failure in the circuitry, an output will be provided over terminal B3 in FIG. 2C to the corresponding terminal B3 in FIG. 2E for causing analog switch 65 to switch to the backup tone alarm message generator shown in FIG. 2D. As can be seen, this circuit is nearly identical to the tone alarm message generator shown in FIG. 2C so that a discussion of the common circuit elements need not be repeated.

The output from the backup tone alarm message generator is taken at line 131. This signal is connected through test switch 132 to the input of switch 133. This switch 133 is closed whenever a backup tone alarm message is desired. Thus, this signal is connected to terminal A9 through switch 133 and provides a third input to analog switch 65 shown in FIG. 2E and is also connected to the input of a supervision circuit which is identical to the supervision circuit shown in FIG. 2C. If the slow whoop tone alarm message is selected, switch 133 and switch 136 are closed. If a fixed frequency tone alarm message signal is desired, switches 133 and 136 are opened and switches 135 and 134 are closed. In the event that the backup tone alarm message supervisory circuit detects a fault condition in the backup tone alarm message generating circuit, trouble lamp 137 is energized and also an output is provided over terminal A7 to the message trouble terminal 117 shown in FIG. 2C.

Finally, a power on reset circuit (FIG. 2E) is provided for resetting all of the hardware in the event of a power on condition. When power is initially turned on, capacitor 141 is charged through resistor 142 to a predetermined voltage. When power is turned off, capacitor 141 is quickly discharged through diode 143. The voltage on capacitor 141 is inverted by inverter 144 which is connected in Schmit trigger fashion and is inverted again by inverter 145 to provide the power on reset signal over terminal A6.

Figure 3:
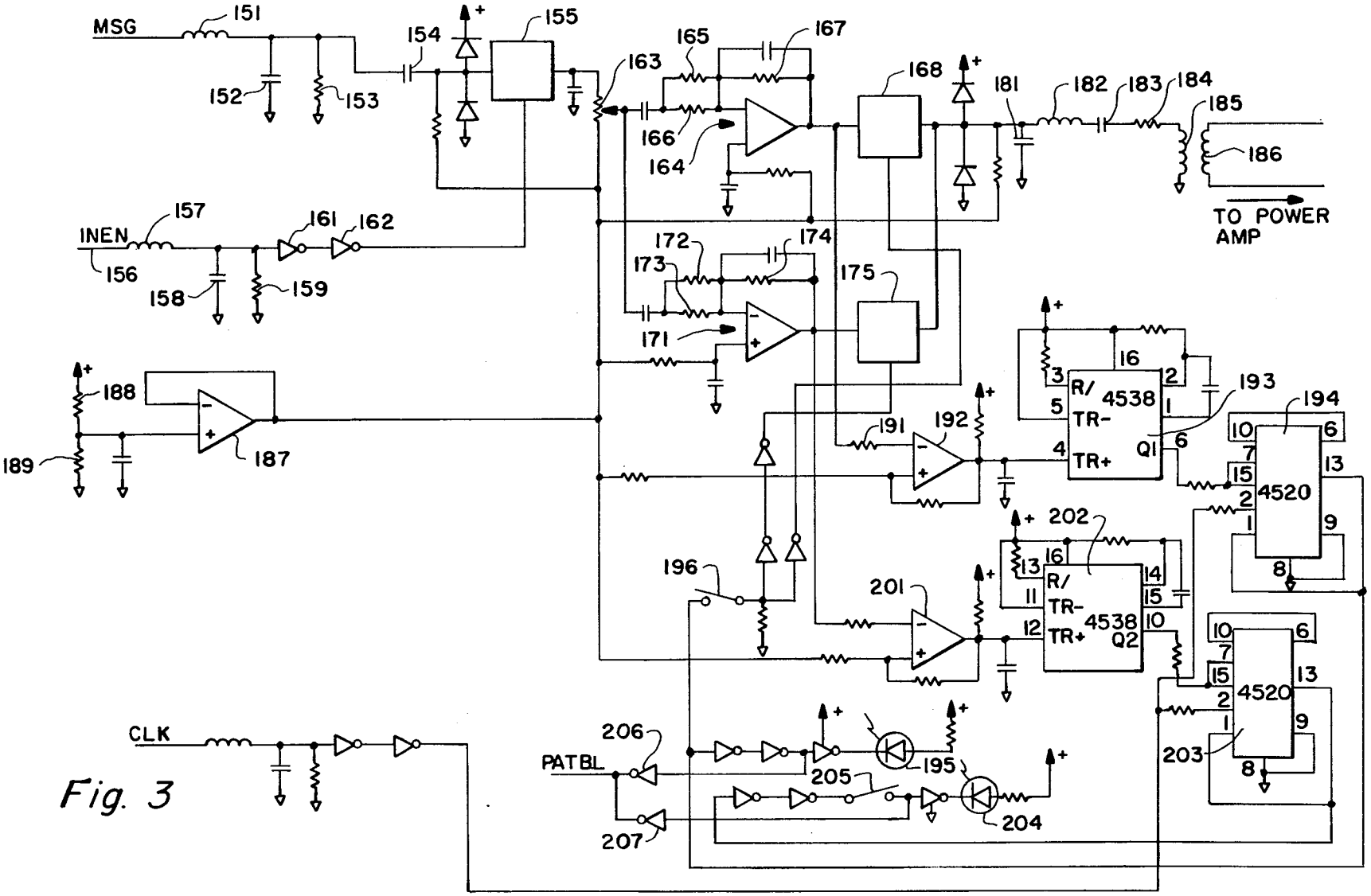
FIG. 3 shows the details of the preamplification section shown in block form in FIG. 1; and, FIG. 4 shows the details of the power amplification supervisory section shown in block form in FIG. 1.

The output from the alarm message generator portion of the alarm message generation means shown in FIG. 1 is taken at terminal MSG in FIG. 2E which is the input terminal for the preamplification section shown in more detail in FIG. 3. A DC bias circuit is provided by voltage follower 187 which has its positive input connected to a voltage divider circuit comprising resistors 188 and 189. The bias signal is applied throughout the circuit as shown.

The alarm message signal is supplied through coil 151 which is provided for static protection and through filter section comprising capacitor 152 and resistor 153. The signal is then supplied through DC blocking capacitor 154 to the input of analog switch 155. Analog switch 155 is controlled by the input enable signal at input 156 which is connected through coil 157 for static protection and a filter section comprising capacitor 158 and resistor 159. The input enable circuit is then buffered by two inverters 161 and 162 before it is supplied to analog switch 155. If the input is enabled, switch 155 is closed to permit the alarm message signal to be connected to variable resistor 163. The signal is then supplied through preamplifier 164 having resistors 165, 166 and 167 for adjusting the gain of this preamplification stage. The output from preamplifier 164 is connected to the input of analog switch 168.

Backup preamplification section 171 is also provided having an input connected to the output of variable resistance 163 and having resistors 172, 173 and 174 for determining the gain of backup preamplification section 171. The output from backup preamplification section 171 is connected to analog switch 175.

The main and backup preamplification supervision circuitry determines which analog switch 168 or 175 connects its input to its output. If the main preamplification circuit is operating correctly, analog switch 168 connects its input to its output which in turn is connected through a filter circuit including capacitor 181, coil 182, capacitor 183 and resistor 184 to primary winding 185 the secondary 186 of which supplies the alarm message to the power amplifier.

Both the main preamplifier and the backup preamplifier are supervised to detect faults in operation by keying off of the alarm message which is being circulated up to the trunk. The alarm message is provided at all times to the preamplifiers and detected at the output of the preamplifiers.

Accordingly, the output of preamplifier 164 is connected through resistance 191 to the input of comparator 192 the other input of which is supplied by bias amplifier 187. Comparator 192 will detect the presence of an analog signal at the output of preamplifier 164 and will switch high and low at each cycle. The output of comparator 192 drives a retriggerable monostable multivibrator 193 which provides a pulse of predetermined minimum width to reset counter 194. Counter 194 is clocked by a clock pulse from the CLK input and is configured to stop counting when the output pin 13 goes high. If counter 194 is not reset within a predetermined period of time, pin 13 wil go high providing an output which will energize LED 195 to indicate a trouble in the main preamplifier and will also operate through switch 196, which is closed if a backup preamplifier is desirable, to open analog switch 168 and close analog switch 175 for connecting the backup preamplifier into the circuit.

Backup preamplifier 171 is supervised by connecting its output to one input of comparator 201 the other input of which is connected to the output of bias amplifier 187. The output of comparator 201 is switched each time its input detects a transition of its analog input. The switching of the output of comparator 201 triggers monostable multivibrator 202 for providing reset pulses to counter 203. As long as reset pulses are supplied to counter 203, its output pin 13 will remain low indicating no trouble with the backup amplifier. If there is no detectable signal at the output of backup preamplifier 171 for a predetermined amount of time, however, the output of comparator 201 will be either high or low but in either case it will be stable and the corresponding monostable multivibrator 202 will not provide a reset pulse to counter 203 output pin 13 of which will go high after a predetermined amount of time. The high output at pin 13 will then energize LED 204 through switch 205 which is closed if a backup preamplifier is desirable. The energization of light 204 indicates trouble in the backup preamplifier circuit.

The outputs from counters 194 and 203 are also connected through respective inverters 206 and 207 so that a preamplifier trouble signal can be provided to a processor.

As shown in FIG. 1, the output of the preamplification circuit is connected to the power amplifier 17. The power amplifier in actuality may comprise two power amplifiers, a main power amplifier and a backup power amplifier. The output of these amplifiers are connected to the inputs of FIG. 4 as indicated.

If the main power amplifier is functioning correctly, its output is connected through the normally closed contacts K1 to contacts K2 which will be closed in the event of an alarm event. Normally open contacts K2 are controlled by a relay K2 which is energized from a trunk enable input signal which changes state upon an alarm event. The change of state of the trunk enable signal will then energize relay K2 to close its normally open contacts K2 for connecting the output of the main power amplifier to the trunk output circuit so that the alarm message can be transmitted through the trunk circuit to the alarm broadcast mechanism which may be in the form of a speaker.

Figure 4:
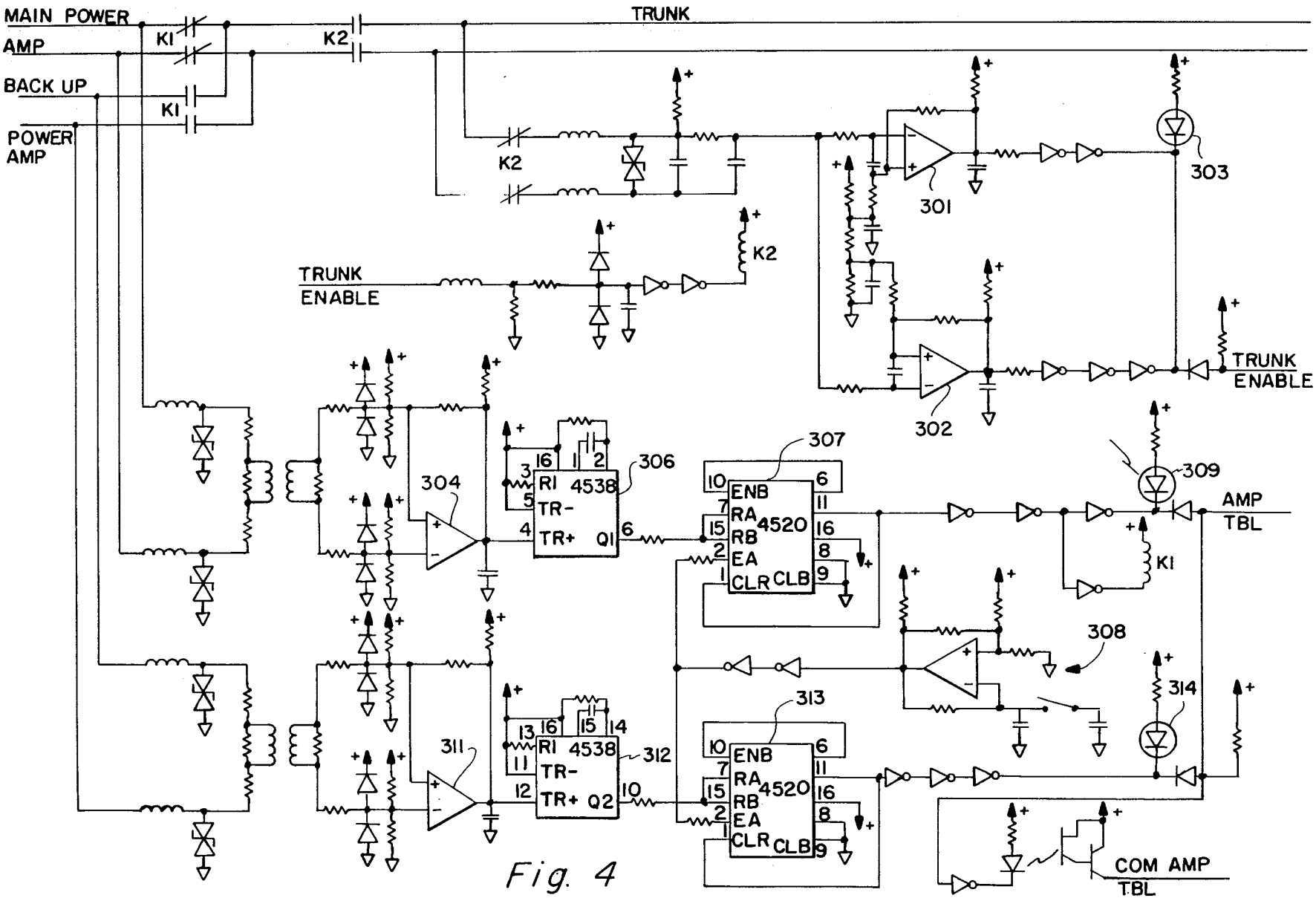

The circuit shown in FIG. 4 provides supervision for the trunk line, the main power amplifier and the backup power amplifier.

DC supervision is used for monitoring the integrity of the trunk line. The audio trunk line is terminated with an end of line resistor. If there is no open or short on the trunk line, the voltage at the inputs of comparators 301 and 301 will be normal so that the output of comparator 301 is high and the output of comparator 302 is low which will maintain LED 303 off and will not provide a trunk trouble output. In the event of an open in the trunk, the voltage at the input of comparator 301 will increase to such a point that the output of comparator 301 switches low turning on LED 303 and providing a trunk trouble output. On the other hand, if the trunk is shorted, the voltage to comparator 302 falls to such a point where its output switches high for again energizing LED 303 and providing a trunk trouble output. The input to this trunk DC supervision circuit is connected through normally closed contacts K2 which are opened in the event of an alarm signal so that the trunk circuit itself is no longer supervised by comparators 301 and 302.

Both the main and backup power amplifiers are supervised by providing the alarm message through the power amplifiers at all times and by detecting this alarm message by the supervisory circuitry. The alarm message is normally not heard because normally open contacts K2 are normally open such that the alarm message is not connected to the trunk line. Comparator 304 detects the presence of this analog alarm message at the output of main amplifier and will switch high and low at each cycle. The output of comparator 304 drives monostable multivibrator 306 which provides pulses of guaranteed minimum width to reset counter 307. As long as counter 307 is repeatedly reset, its output pin 11 will not go high and will not provide an amplifier trouble output. Counter 307 is provided with clock pulses from oscillator 308. If there is no detectable signal at the output of the main power amplifier for a predetermined amount of time, the output of comparator 304 will be either high or low but in either case it will be stable and will not provide triggering pulses to monostable multivibrator 306 which will not in turn provide reset pulses to counter 307. Accordingly, pin 11 will go high which will turn on amplifier trouble indicator 309 and will also provide an amplifier trouble output signal which can be used by a processor. Also, relay coil K1 is energized in the event of trouble with the main power amplifier which will open up normally closed contacts K1 and close normally open contacts K1 so that the backup power amplifier is now connected to the inputs of normally open contacts K2 so that the output from the backup amplifier can be connected to the trunk line in the event of an alarm event.

The backup amplifier is supervised by comparator 311 which detects the presence of the analog alarm message and will switch high and low at each cycle. The output of comparator 311 drives monostable multivibrator 312 to provide pulses of predetermined minimum width to reset counter 313 which is also supplied by clock pulses from clock source 308. As long as counter 313 is continuously reset, its output pin 11 will not go high. In the event of trouble with the backup power amplifier, the output pin 11 of counter 313 will go high which will energize the backup trouble indicating light 314 and will also supply an output to the amplifier trouble output.

The embodiments of the invention in which an exclusive property or right is claimed are defined as follows:

1. An alarm message generation and broadcast system having supervision comprising:

alarm message generation means for generating an alarm message;

an output for receiving said alarm message so that said alarm message can be broadcast in response to an alarm event; and, supervision means connected to said alarm message generation means and responsive to said alarm message for providing a trouble signal when said alarm message is not properly received by said supervision means.

2. The system of claim 1 wherein said alarm message generation means comprises means for generating a speech alarm message so that a speech alarm message can be broadcast in response to an alarm event.

3. The system of claim 2 wherein said supervision means comprises speech supervision means connected to receive said speech alarm message for providing a trouble signal when said speech alarm message is not properly received by said speech supervision means.

4. The system of claim 3 wherein said alarm message generation means comprises tone alarm message generation means for generating a tone alarm message to be broadcast in response to an alarm event.

5. The system of claim 4 wherein said supervision means comprises tone supervision means connected to receive said tone message for providing a trouble signal when said tone alarm message is not properly received by said tone supervision means.

6. The system of claim 5 wherein said tone alarm message generation means generates a variable frequency tone alarm message.

7. The system of claim 6 wherein said tone supervision means comprises high frequency tone supervision means for sensing high frequency components of said tone alarm message and low frequency tone supervision means for sensing low frequency components of said tone alarm message.

8. The system of claim 1 wherein said alarm message generation means comprises an alarm messge generator for generating said alarm message and amplification means for amplifying said alarm message.

9. The system of claim 8 wherein said supervision means comprises amplification means supervision means responsive to the alarm message supplied by said amplification means for providing a trouble signal when said alarm message supplied by said amplification means is not properly received by said amplification means supervision means.

10. The system of claim 8 wherein said supervision means comprises alarm message generator supervision means for supervising said alarm message supplied by said alarm message generator for providing a trouble signal when said alarm message is not properly received by said alarm message generator supervision means.

11. The system of claim 10 wherein said supervision means comprises amplification means supervision means responsive to the alarm message supplied by said amplification means for providing a trouble signal when said alarm message supplied by said amplification means is not properly received by said amplification means supervision means.

12. The system of claim 11 wherein said alarm message generator comprises means for generating a speech alarm message so that a speech alarm message can be broadcast in response to an alarm event.

13. The system of claim 12 wherein said alarm message generator supervision means comprises speech supervision means connected to receive said speech alarm message for providing a trouble signal when said speech alarm message is not properly received by said speech supervision means.

14. The system of claim 13 wherein said alarm message generator comprises tone alarm message generation means for generating a tone alarm message to be broadcast in response to an alarm event.

15. The system of claim 14 wherein said alam message generator supervision means comprises tone supervision means connected to receive said tone message for providing a trouble signal when said tone alarm message is not properly received by said tone supervision means.

16. The system of claim 15 wherein said tone alarm message generation means generates a variable frequency tone alarm message.

17. The system of claim 16 wherein said tone supervision means comprises high frequency tone supervision means for sensing high frequency components of said tone alarm message and low frequency tone supervision means for sensing low frequency components of said tone alarm message.

18. An alarm message generation and broadcast system having supervision comprising:

alarm message generation means for generating a variable frequency alarm message;

an output for receiving said variable frequency alarm message so that said variable frequency alarm message can be broadcast in response to an alarm event; and, supervision means connected to said alarm message generation means and responsive to said variable frequency alarm message for providing a trouble signal when said variable frequency alarm message is not properly received by said supervision means.

19. The system of claim 18 wherein said alarm message generation means comprises means for generating a variable frequency speech alarm message so that a variable frequency speech alarm message can be broadcast in response to an alarm event.

20. The system of claim 19 wherein said supervision means comprises speech supervision means connected to receive said variable frequency speech alarm message for providing a trouble signal when said variable frequency speech alarm message is not properly received by said speech supervision means.

21. The system of claim 20 wherein said alarm message generation means comprises variable frequency tone alarm message generation means for generating a variable frequency tone alarm message to be broadcast in response to an alarm event.

22. The system of claim 21 wherein said supervision means comprises tone supervision means connected to receive said variable frequency tone message for providing a trouble signal when said variable frequency tone alarm message is not properly received by said tone supervision means.

23. The system of claim 22 wherein said tone supervision means comprises high frequency tone supervision means for sensing high frequency components of said variable frequency tone alarm message and low frequency tone supervision means for sensing low frequency components of said variable frequency tone alarm message.

24. The system of claim 18 wherein said alarm message generation means comprises an alarm message generator for generating said variable frequency alarm message and amplification means for amplifying said variable frequency alarm message.

25. The system of claim 24 wherein said supervision means comprises amplification means supervision means responsive to the variable frequency alarm message supplied by said amplification means for providing a trouble signal when said variable frequency alarm message supplied by said amplification means is not properly received by said amplification means supervision means.

26. The system of claim 24 wherein said supervision means comprises alarm message generator supervision means for supervising said variable frequency alarm message supplied by said alarm message generator for providing a trouble signal when said variable frequency alarm messaage is not properly received by said alarm message generator supervision means.

27. The system of claim 26 wherein said supervision means comprises amplification means supervision means responsive to the variable frequency alarm message supplied by said amplification means for providing a trouble signal when said variable frequency alarm message supplied by said amplification means is not properly received by said amplification means supervision means.

28. The system of claim 27 wherein said alarm message generator comprises means for generating a variable frequency speech alarm message so that a speech alarm message can be broadcast in response to an alarm event.

29. The system of claim 28 wherein said alarm message generator supervision means comprises speech supervision means connected to receive said variable frequency speech alarm message for providing a trouble signal when said variable frequency speech alarm message is not properly received by said speech supervision means.

30. The system of claim 29 wherein said alarm message generator comprises tone alarm message generation means for generating a variable frequency tone alarm message to be broadcast in response to an alarm event.

31. The system of claim 30 wherein said alarm message generator supervision means comprises tone supervision means connected to receive said variable frequency tone alarm message for providing a trouble signal when said variable frequency tone alarm message is not properly received by said tone supervision means.

32. The system of claim 31 wherein said tone supervision means comprises high frequency tone supervision means for sensing high frequency components of said variable frequency tone alarm message and low frequency tone supervision means for sensing low frequency components of said variable frequency tone alarm message.

33. An alarm message generation and broadcast system having supervision comprising:

alarm message generation means for generating a variable frequency speech alarm message;

an output for receiving said variable frequency speech alarm message so that said variable frequency speech alarm message can be broadcast in response to an alarm event; and, supervision means connected to said alarm message generation means and responsive to said variable frequency speech alarm message for providing a trouble signal when said variable frequency speech alarm message is not properly received by said supervision means.

34. The system of claim 33 wherein said alarm message generation means comprises variable frequency tone alarm message generation means for generating a variable frequency tone alarm message to be broadcast in response to an alarm event.

35. The system of claim 34 wherein said supervision means comprises tone supervision means connected to receive said variable frequency tone alarm message for providing a trouble signal when said variable frequency tone alarm message is not properly received by said tone supervision means.

36. The system of claim 35 wherein said tone supervision means comprises high frequency tone supervision means for sensing high frequency components of said variable frequency tone alarm message and low frequency tone supervision means for sensing low frequency components of said variable frequency tone alarm message.

37. The system of claim 33 wherein said alarm message generation means comprises an alarm message generator for generating said variable frequency speech alarm message and amplification means for amplifying said variable frequency speech alarm message.

38. The system of claim 37 wherein said supervision means comprises amplification means supervision means responsive to the variable frequency speech alarm message supplied by said amplification means for providing a trouble signal when said variable frequency speech alarm message supplied by said amplification means is not properly received by said amplification means supervision means.

39. The system of claim 37 wherein said supervision means comprises variable frequency speech alarm message generator means for supervising said variable frequency speech alarm message supplied by said alarm message generator for providing a trouble signal when said variable frequency speech alarm message is not properly received by said variable frequency speech alarm message generator supervision means.

40. The system of claim 39 wherein said supervision means comprises amplification means supervision means responsive to the variable frequency speech alarm message supplied by said amplification means for providing a trouble signal when said variable frequency speech alarm message supplied by said amplification means is not properly received by said amplification means supervision means.

41. The system of claim 40 wherein said alarm message generator comprises tone alarm message generation means for generating a variable frequency tone alarm message to be broadcast in response to an alarm event, said amplification means selectively amplifying said variable frequency tone alarm message and said amplification means supervision means selectively supervising said variable frequency tone alarm message.

42. The system of claim 41 wherein said supervision means comprises tone supervision means connected to receive said variable frequency tone alarm message for providing a trouble signal when said variable frequency tone alarm message is not properly received by said tone supervision means.

43. The system of claim 42 wherein said tone supervision means comprises high frequency tone supervision means for sensing high frequency components of said variable frequency tone alarm message and low frequency tone supervision means for sensing low frequency components of said variable frequency tone alarm message.

44. The system of claim 1 wherein said alarm message is of a predetermined frequency and said supervision means comprises frequency sensitive means for producing pulses corresponding to said frequency, said supervision means further comprising counter means resettable by said pulses for providing a trouble signal in absence of said pulses.

45. The system of claim 3 wherein said speech alarm message has a variable frequency and said supervision means comprises frequency sensitive means for producing pulses coresponding to said frequency, said supervision means further comprising counter means resettable by said pulses for providing a trouble signal in absence of said pulses.

46. The system of claim 18 wherein said supervision means comprises frequency sensitive means for producing pulses corresponding to said frequency, said supervision means further comprising counter means resettable by said pulses for providing a trouble signal in absence of said pulses.

47. The system of claim 20 wherein said supervision means comprises frequency sensitive means for producing pulses corresponding to said frequency, said supervision means further comprising counter means resettable by said pulses for providing said trouble signal in absence of said pulses.

48. The system of claim 33 wherein said supervision means comprises frequency sensitive means for producing pulses corresponding to said frequency, said supervision means further comprising counter means resettable by said pulses for providing said trouble signal in absence of said pulses.

* * * * *